US007143962B2

(12) United States Patent
Kah, Jr.

(10) Patent No.: US 7,143,962 B2
(45) **Date of Patent: *Dec. 5, 2006**

(54) SELECTED RANGE ARC SETTABLE SPRAY NOZZLE WITH PRE-SET PROPORTIONAL CONNECTED UPSTREAM FLOW THROTTLING

(76) Inventor: Carl L. C. Kah, Jr., 11517 Turtle Beach Rd., Lost Tree, North Palm Beach, FL (US) 33048

( * ) Notice: Subject to any disclaimer, the term of this patent is extended or adjusted under 35 U.S.C. 154(b) by 0 days.

This patent is subject to a terminal disclaimer.

(21) Appl. No.: 11/023,247

(22) Filed: Dec. 27, 2004

(65) Prior Publication Data

US 2005/0103901 A1 May 19, 2005

Related U.S. Application Data

(63) Continuation of application No. 10/207,521, filed on Jul. 25, 2002, now Pat. No. 6,834,816.

(60) Provisional application No. 60/307,686, filed on Jul. 25, 2001.

(51) Int. Cl.
*B05B 1/32* (2006.01)

(52) U.S. Cl. ..... 239/451; 239/457; 239/498; 239/460; 239/513; 239/581.2; 239/539; 239/541

(58) Field of Classification Search ..... 239/451, 239/457, 456, 518, 521, 523, 524, 537, 538, 239/539, 541, DIG. 1, 107, 201, 205, 206, 239/460, 498, 513, 222.17, 223, 224
See application file for complete search history.

(56) References Cited

U.S. PATENT DOCUMENTS

| | | | | |
|---|---|---|---|---|
| 4,579,285 | A | 4/1986 | Hunter | |
| 4,753,391 | A * | 6/1988 | Rogers | 239/203 |
| 4,842,201 | A * | 6/1989 | Hunter | 239/396 |
| 4,986,474 | A * | 1/1991 | Schisler et al. | 239/205 |
| 5,288,022 | A * | 2/1994 | Sesser | 239/205 |
| 5,556,036 | A * | 9/1996 | Chase | 239/457 |
| 5,588,594 | A | 12/1996 | Kah, Jr. | |
| 6,834,816 | B1 * | 12/2004 | Kah, Jr. | 239/451 |

* cited by examiner

*Primary Examiner*—Dinh Q. Nguyen
(74) *Attorney, Agent, or Firm*—Ostrolenk, Faber, Gerb & Soffen, LLP

(57) ABSTRACT

A selected range arc settable spray nozzle with pre-set table precipitation rate in which the arc of coverage adjustment is coupled to an upstream flow throttling valve. As the arc of coverage is adjusted, the opening of the upstream flow throttling valve is proportionally adjusted to maintain the precipitation rate substantially constant independent of arc of coverage adjustments. Upstream flow throttling achieved by use of pre-selected number of larger slots for desired flow whose opening area is varied as the arc is being set. The precipitation rate is set by adjusting the throttling valve to provide the desired flow rate for the maximum arc of coverage setting. A pressure compensating valve may also be provided.

28 Claims, 2 Drawing Sheets

SELECTED RANGE ARC SETTABLE SPRAY NOZZLE WITH PRE-SET PROPORTIONAL CONNECTED UPSTREAM FLOW THROTTLING

CROSS REFERENCE TO RELATED APPLICATION

The present application is a continuation under 37 C.F.R. §1.53(b) of prior application Ser. No. 10/207,521, filed Jul. 25, 2002, now U.S. Pat. No. 6,834,816 by Carl L. C. Kah, Jr., entitled SELECTED RANGE ARC SETTABLE SPRAY NOZZLE WITH PRE-SET PROPORTIONAL CONNECTED UPSTREAM FLOW THROTTLING, which is based on and claims benefit of U.S. Provisional Patent Application No. 60/307,686 filed Jul. 25, 2001 entitled SELECTED RANGE ARC SETTABLE SPRAY NOZZLE WITH PRE-SET PROPORTIONAL CONNECTED UPSTREAM FLOW THROTTLING, the disclosure of which is hereby incorporated by reference and to which a claim of priority is hereby made.

BACKGROUND OF THE INVENTION

1. Technical Field

This invention relates to adjustable arc of coverage spray nozzles, and more particularly, to such nozzles which have preset spray ranges, and in which an upstream throttling valve is proportionally mechanically coupled to the arc of coverage adjustment so that a substantially constant precipitation rate can be selected and provided as the arc of coverage is adjusted. The invention also relates to sprinkler systems including a plurality of such nozzles with different spray ranges.

2. Relevant Prior Art

Sprinkler nozzles are known which have an adjustable arc of coverage, e.g., as shown in Hunter U.S. Pat. No. 4,579,285, and in my U.S. Pat. No. 5,588,594.

My U.S. patent application Ser. No. 10/100,259 entitled SPRAY NOZZLE WITH ADJUSTABLE ARC SPRAY ELEVATION ANGLE AND FLOW, filed Mar. 15, 2002 discloses an adjustable range and arc of coverage nozzle having an adjustable arcuate spray slot in which the arc setting mechanism is linked to an upstream throttling valve to proportionally control the flow to the spray slot as the arc of spray coverage is increased or decreased. Although other arc-settable spray nozzles that have adjustable upstream throttling valves are also known, the upstream throttling valve areas of these are not preset at the factory during assembly to provide the correct flow rate for the desired range of coverage while still maintaining the same larger adjustable slot width, and if adjusted, are not designed to provide proportionally increasing area openings as the arc of coverage is increased for substantially uniform precipitation independent of the arc of coverage setting.

The short range adjustable arc nozzles which are now on the market have adjustable arcuate slot orifices that are quite thin e.g., less than 0.030 inch, to reduce the flow rates for the shorter ranges of coverage such as 8 feet. These very thin slots are easily clogged and require fin filters having correspondingly small openings, which themselves are easily clogged.

There is accordingly a need for an improved adjustable arcuate slot nozzle in which an upstream proportional flow rate adjusting valve and an arc of coverage adjustment mechanism are coupled so that a substantially constant pre-settable precipitation rate is obtained for different arcs of coverage when the desired flow rate is less than what the adjustable arcuate slot alone provides. The present invention seeks to address this need, in addition to having the nozzles preset at the factory to provide selected shorter ranges of coverage such as 8, 10, 12, and 15 feet.

SUMMARY OF THE INVENTION

According to this invention, a simple arc-settable spray nozzle may have a relatively large adjustable arc spray slot width (e.g., at least 0.030 in.) for even short range nozzle configurations. Also, by proportionally throttling the flow upstream of the adjustable arc slot, the width of the open area of the arcuate slot can be substantially constant and uniform, independent of the arc setting. The upstream valve can be formed of one or more relatively large axial-width openings which concentrate the flow area in larger size grooves of a selected shape to proportionately open or close the flow area as the upstream throttling valve member is moved axially during setting of the desired arc of coverage. Since the upstream flow is concentrated into a small number of openings or grooves while still providing significant throttling, the adjustable arcuate spray slot may now have a greater opening size while still providing the desired lower flow rate for the short range nozzles.

As the arc opening of the adjustable arcuate spray slot is varied by rotation of a spray nozzle deflector and flow control member, a coupled throttling valve element varies the area of the upstream openings. Due to the configuration of the upstream openings, and other parts, the throttling is proportional to the arc opening of the arcuate spray slot.

Also, a pressure compensating configuration is disclosed in which one member of the upstream throttling valve is made of a flexible material so that it is pressure responsive. Thus, if the inlet pressure increases, the throttling valve flow area is reduced to compensate for the pressure change.

It is accordingly an object of the present invention to provide an improved adjustable arc of coverage sprinkler nozzle.

It is another object of the present invention to provide an improved adjustable arc of coverage sprinkler nozzle in which an upstream flow rate adjusting valve provides proportional adjustment to match the rotational and axial movement of the coupled arc of coverage adjustment mechanism so that a substantially constant precipitation rate is obtained for different arcs of coverage, even when the flow rate is preadjusted to be less than would flow from the adjustable arcuate slot alone to provide for the same precipitation rate.

It is yet another object of the present invention to provide an improved adjustable arc of coverage sprinkler nozzle in which an upstream flow rate adjusting valve and an arc of coverage adjustment mechanism can be pre-set, for example, during assembly at the factory, to provide a substantially constant pre-selected precipitation rate for different arcs of coverage, and in which different maximum-flow settings of the upstream flow rate adjusting valve are provided for different ranges of coverage.

It is a further object of the present invention to provide an improved adjustable arc of coverage sprinkler nozzle with a coupled upstream flow rate adjusting valve and different configurations for different ranges of coverage in which the short range valve configurations are less subject to contamination by dirt than in conventional nozzles.

Another object of the invention is to provide a fixed range spray nozzle in which the exit elevation angle of the nozzle flow control deflector determines the spray range and the precipitation rate may be adjusted with an upstream flow control valve whose flow rate is proportionally controlled by a mechanical linkage with the arc of coverage setting mechanism for the adjustable arc of coverage slot.

So that the nozzle can be used for different spray ranges as part of a sprinkler system, the flow control mechanism includes an interchangeable deflector that determines the range, and the maximum flow rate for an upstream throttling valve is preset to match the selected range by pre-positioning a movable valve member relative to a plurality of axial outlet orifice slots which concentrate the flow out of the throttling valve, and are configured to provide the required proportional flow adjustability. This construction allows use of outlet slots that are large enough to minimize the risk of obstruction by dirt for even the smallest range nozzle.

In a second embodiment, the flow throttling valve body is formed by a resilient diaphragm that includes one or more axial outlet orifice slots. The diaphragm includes a folded area that deflects in response to increased inlet water pressure, and thereby reduces the area of the outlet opening. By properly selecting the thickness and rigidity of the folded area, the changes in the size of the outlet opening can compensate for pressure variations and thus help keep the flow more constant at elevated inlet pressures.

Other features and advantages of the present invention will become apparent from the following description of the invention which refers to the accompanying drawings.

DETAILED DESCRIPTION OF THE INVENTION

Figure 1:
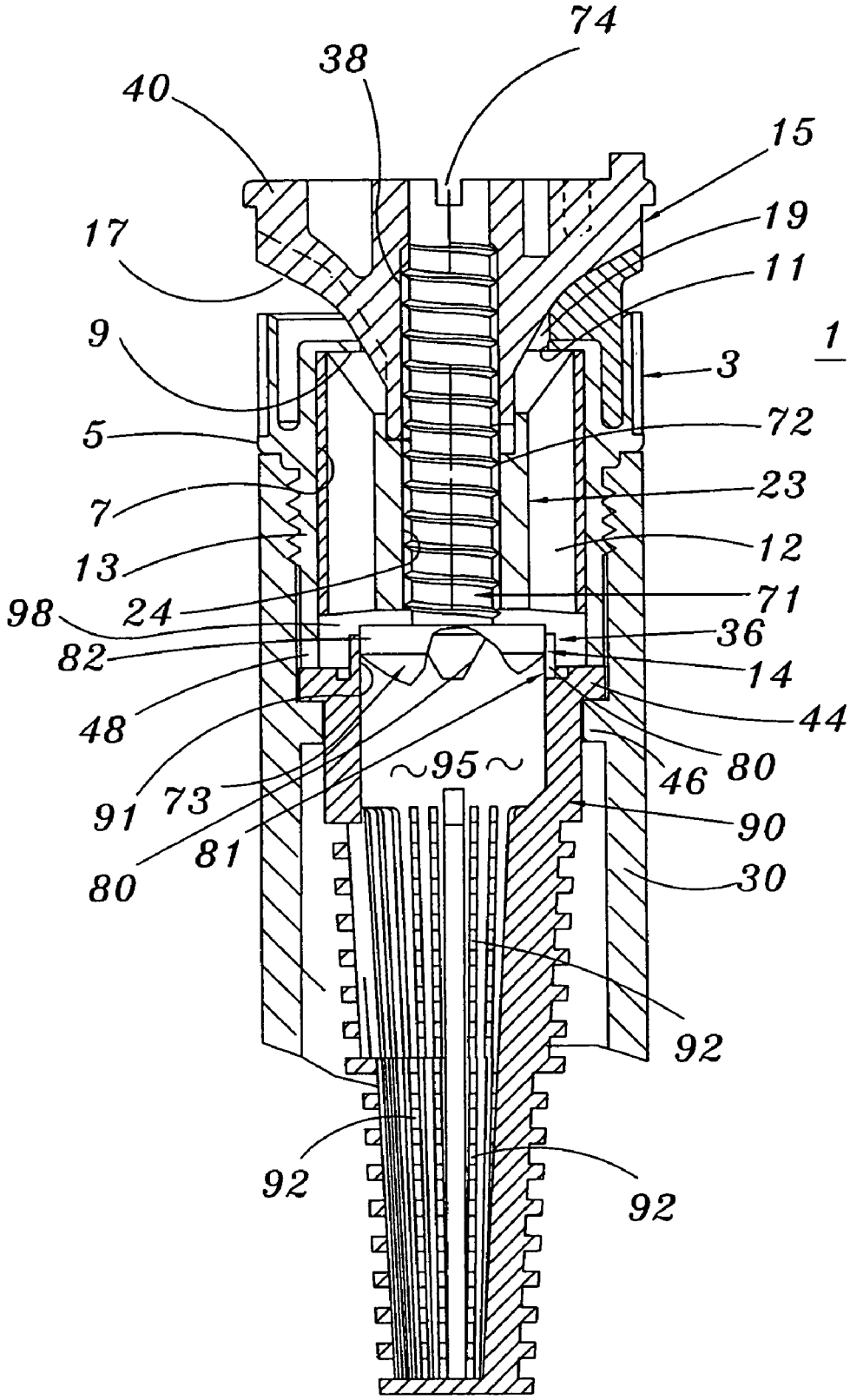
FIG. 1 is a cross-sectional view of a first embodiment of an adjustable arc spray nozzle according to the invention, including the upstream throttling valve and a matching filter mounted on a partial sprinkler riser tube.

Referring to FIG. 1, a first embodiment of an adjustable arc of coverage spray nozzle according to this invention, generally indicated at 1, is comprised of a cylindrical housing 3, a central body insert 23, an adjustable arc-of-coverage flow control member 15, an upstream flow throttling valve assembly 36, and a rotatable and axially movable central adjusting shaft 71 with a valving head 73 at its lower end, and an adjusting slot 74 at its upper end.

Cylindrical housing 3 is comprised of a generally circular outer wall 5 that defines an internal cavity 7, an outlet end closure top wall 9, the latter including a radically spiraled opening 11 that forms an arcuate water discharge orifice or spray slot, and a downwardly depending externally threaded skirt portion 13 that couples the nozzle to a conventional riser tube 30, by which pressurized water for the sprinkler may be supplied.

A filter 90 is positioned within riser tube 30, and is retained by a shoulder portion 44 that is held between a complementary shoulder 46 on the inside of tube 30 and the bottom end 48 of skirt portion 13 of housing 3. Filter 90 is of generally conventional construction, and includes a plurality of filter openings 92 through which water flows into an inner cavity 95 at its downstream or top end.

Cavity 95 functions as a valve housing or body for flow throttling valve assembly 36, as described below.

Body insert 23 is positioned in central cavity 7 of housing 3, and is supported therein by circumferentially spaced axial ribs 12. These can be integrally molded with insert 23; alternatively, a separate spacer including ribs 12 may be positioned in cavity 7 around insert 23.

Flow adjusting shaft 71 includes a threaded body portion 72, a valve adjusting member 73 at its lower end, and an adjustment slot 74, or the like, at the top.

The upper end of flow control adjusting shaft body portion 72 is received in an internally threaded central bore 38 in a body portion 40 of the arc-of-coverage flow control member 15. The portion of adjusting shaft body 72 that extends below flow control member body 40 is threadedly received in an internally threaded central bore 24 in body insert 23.

The fit between adjusting shaft body 72 and central bore 24 is such that shaft 71 is rotationally and axially movable within bore 24, while the frictional fit between bore 38 and adjusting shaft body 72 is sufficiently tight that deflector body 40 and adjusting shaft 71 normally move together. Thus adjusting shaft 71 moves axially within bore 24 as deflector body 40 is manually rotated to adjust the arc of coverage.

The deflector body 40 includes a sloped axially spiraled surface 17 which cooperates with the radially spiraled housing slot 11 to provide a sealable variable-arc exit opening 19 that is rotationally adjustable from approximately zero to 360 degrees. The slope of deflector body 40 also determines the exit angle of the water stream through exit opening 19, and therefore, the range of the nozzle. Further details of the construction and operation of the adjustable arcuate orifice spray nozzle is provided in commonly owned U.S. Pat. No. 5,588,594, the content of which is incorporated herein by reference as if fully set forth.

Throttling valve member 73 mounted on the lower end of adjusting shaft 71 cooperates with a cavity 95 at the top of filter 90 to form flow throttling valve assembly 36. Throttling valve member 73 may be formed separately or as an integral part of adjusting shaft 71. Likewise, the flow valve housing may also be created as a cylindrical skirt depending from the bottom of spray nozzle housing insert 23. The interior wall 91 of cavity 95 includes a downstream outlet or orifice region defined by a plurality of axial slots or shaped flow openings 80 which communicate with the lower end 98 of housing cavity 7. The outside circumference of throttling valve member portion 82 can be a 1:1 fit with interior wall 91 of the filter cavity 95.

As adjusting shaft 71 moves axially due to rotation of deflector body 40, throttling valve member 73 moves up or down within cavity 95. This progressively uncovers (or covers) slots 80, and changes the flow area and thus the flow rate of valve 36. After the water flows through outlet slots 80, it then flows axially upward through passages formed between insert 23 supporting ribs 12, and through cavity 7 to exit orifice 19.

As will be appreciated by those skilled in the art, the precise configuration of outlet slots 80, which may have an axially varying width, can be selected in coordination with the configurations of deflector body 40 and arcuate slot 11, and the pitch of thread 72 to produce desired flow rate variations as valve member 73 moves with shaft 71. According to this invention, these selections are made so that manual adjustment of the arc of coverage (by rotating deflector body 40) produces a proportional change in the flow area of throttling valve 36.

Because of this proportional adjustment, the flow through nozzle opening 19 is substantially constant independent of arc adjustment, and the desired substantially constant precipitation rate can be maintained.

As will further be appreciated by those skilled in the art in light of the disclosure herein, the axial position of valve member 73 when slot deflector body 40 is adjusted relative to slot 11 for the maximum arc of coverage determines the maximum flow rate, and therefore the precipitation rate. This remains fixed because adjusting shaft 71 rotates with deflector body 40.

However, as another feature of this invention, the threaded fit between adjusting shaft body 72 and threads 24 is designed to allow shaft 71 to be rotated relative to deflector body 40 for adjustment. Thus, if deflector body 40 is immobilized at the position corresponding to the maximum arc of coverage, and a tool is engaged in adjusting slot 74, the axial position of valve member 73 can be adjusted. This can be done during assembly at the factory to provide nozzles of different precipitation rates for the same range of coverage with the same parts.

The proportional flow control and the ability to preset a full arc of coverage position for throttling valve 36 is an important improvement over existing designs.

The slope of deflector body 40 primarily determines the spray range. Thus, a complete sprinkler system having nozzles with one predetermined precipitation rate for different spray ranges can be assembled from common parts except for interchangeable deflector bodies 40. Filter 90 (even if the upper end serves as the body of throttling valve 36) may be a common part with precipitation rate adjusted by pre-positioning adjusting shaft 71 and flow control head 73.

The illustrated construction allows slots 80 each to be larger than the openings 92 in filter 90. In contrast, a continuous slot surrounding the outer circumference of valve member upper portion 82 would have to be narrower that the filter opening for short range nozzles and would consequently be more likely to be obstructed by dirt. Compensation for this by using a filter with smaller openings would only make the filter more prone to obstruction.

Even though the spray nozzle range can be somewhat reduced by a smaller spray deflector elevation angle, if the flow rate is not also reduced, the precipitation rate would be very high for the reduced area of coverage, and the spray angle would have to be reduced to flat or inverted unless the flow is throttled upstream or the adjustable arc discharge slot is made small, (i.e. 0.010 in.) for some of the shortest ranges desired. Reducing the range in half, for example, reduces the flow rate for the same precipitation rate by a factor of four.

Figure 2:
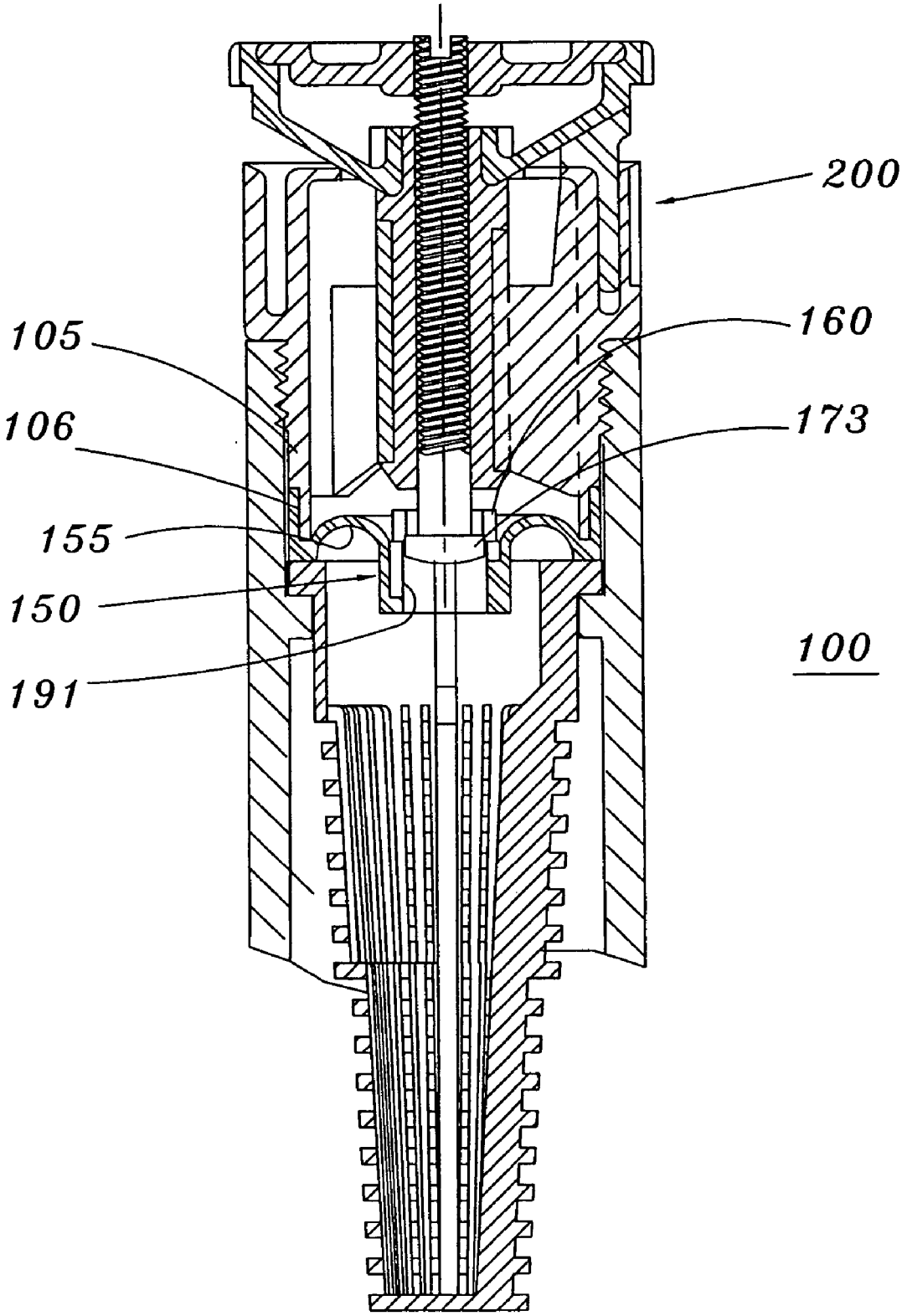
FIG. 2 is a cross-sectional view similar to FIG. 1 showing a second embodiment of the invention, in which the upstream throttling valve includes a flexible stator member to provide pressure compensation.

FIG. 2 illustrates a modified embodiment of the arc settable spray nozzle of this invention. The modified nozzle, generally denoted at 100 is similar to the embodiment previously described except that the upstream throttling valve is formed by valve member 173 and the valve body is formed by a resilient pressure compensating diaphragm 150 which is snap attached to the bottom end of the spray nozzle body 105 at 106. Member 150 includes an axial slot 191 which functions as an outlet orifice.

Pressure compensating member 150 includes a folded area 155. The structure deflects in response to increased inlet water pressure, thereby reducing the throttling slot opening. By properly selecting the thickness and rigidity of folded area 155, the changes in the size of the throttling slot opening can compensate for pressure variations by their axial position and thus help keep the flow more constant at elevated inlet pressures. Ribs 160 may be provided to keep the pressure compensating member 150 from being excessively deflected which might totally shut off the flow at very high pressure.

Although the present invention has been described in relation to particular embodiments thereof, many other variations and modifications and other uses will become apparent to those skilled in the art the scope of the present invention is therefore not intended to be limited not by the specific disclosure herein.

The invention claimed is:

1. An adjustable arc of coverage sprinkler nozzle comprising:

a housing having an arcuate exit slot, an area of which is adjustable to vary the arc of coverage; and a flow control mechanism including:

an interchangeable member which establishes a selected spray range; and a flow rate adjusting member located upstream of the nozzle exit slot, wherein, as the arc of coverage is adjusted, the flow rate adjusting member automatically adjusts the flow rate proportionally according to the arc of coverage setting to provide an approximately constant flow rate per unit area of coverage for all arc settings.

2. A nozzle according to claim 1, wherein the maximum flow rate is preset upon installation of the interchangeable member to provide a desired flow rate per unit area of coverage for the maximum settable arc of coverage.

3. A nozzle as described in claim 1, wherein the nozzle slot extends around the nozzle housing and a transverse dimension of the nozzle slot is the same for all spray ranges.

4. A nozzle as described in claim 1, wherein:

the flow control adjusting mechanism includes:

a valve body;

a valve member movable in the valve body along a path as the arc of coverage setting is adjusted; and a plurality of slots in the valve body which communicate with a passage leading to the nozzle slot and which are elongated in the direction of the path of movement of the valve member; and the area of the slots is increased and decreased as the valve member moves to provide proportional flow control.

5. A nozzle as described in claim 1, wherein the direction of the path of movement of the valve member and the direction of elongation of the slots is generally in the direction of water flow from a supply to the nozzle exit slot.

6. A nozzle as described in claim 1, wherein the flow rate adjusting mechanism includes:

an elongated control slot which communicates with a passage leading to the nozzle slot; and a closure member which is movable in the direction of elongation of the control slot to increase or decrease the area of the control slot as the arc of coverage is adjusted.

7. A nozzle as described in claim 6, wherein the interchangeable member is a deflector tat determines the vertical angle at which water exits the sprinkler, thereby determining the range of the nozzle, and which is movable relative to the arcuate opening to determine the arc of coverage.

8. A nozzle as described in claim 7, wherein the closure member is connected to the deflector and is normally movable therewith to adjust the area of the control slot as the arc of coverage is adjusted.

9. A nozzle as described in claim 8, wherein the maximum flow rate is preset upon installation of the interchangeable member to provide a desired flow rate per unit area of coverage for the maximum settable arc of coverage.

10. A nozzle as described in claim 8, wherein the closure member is movable relative to the interchangeable member to change the flow rate per unit area of coverage for the maximum settable arc of coverage.

11. A nozzle as described in claim 6, wherein the flow rate adjusting mechanism includes a resilient diaphragm with the control slot extending axially therein.

12. A nozzle as described in claim 11, wherein:

the diaphragm includes a circumferentially extending folded area, the folded area being deformable in response to changes in water pressure to change the size of the control slot; and the thickness and resiliency of the folded area are selected so that changes in the size thereof compensate for pressure variation-s and thus help keep the flow more constant at elevated inlet pressures.

13. A sprinkler system comprising a plurality of nozzles as described in claim 1, the nozzles including interchangeable members respectively configured to provide at least two different spray ranges.

14. A sprinkler system as described in claim 13, wherein the respective flow rate adjusting mechanisms in the nozzles have different configurations according to the spray ranges of the individual nozzles.

15. A sprinkler having an adjustable arc of coverage and a selected spray range comprising:

a nozzle having an arcuate exit flow slot area which is adjustable in size to vary the arc of coverage; and a flow control mechanism including:

an interchangeable member which establishes a selected spray range; and a flow rate adjusting member located upstream of the nozzle, wherein, as the arc of coverage is adjusted, the flow rate adjusting member automatically adjusts the flow rate proportionally according to the arc of coverage setting to provide an approximately constant range of spray coverage independent of the arc setting.

16. A nozzle as described in claim 15, wherein the maximum flow rate is preset upon installation of the interchangeable member to provide a desired flow rate per unit area of coverage for the maximum settable arc of coverage.

17. A nozzle as described in claim 15, wherein the nozzle slot extends around the nozzle housing and a transverse dimension of the nozzle slot is the same for all spray ranges.

18. A nozzle as described in claim 15, wherein:

the flow control adjusting mechanism includes:

a valve body;

a valve member movable in the valve body along a path as the arc of coverage setting is adjusted; and a plurality of slots in the valve body which communicate with a passage leading to the nozzle slot and which are elongated in the direction of the path of movement of the valve member; and the area of the slots is increased and decreased as the valve member moves to provide proportional flow control.

19. A nozzle as described in claim 15, wherein the direction of the path of movement of the valve member and the direction of elongation of the slots is generally in the direction of water flow from a supply to the nozzle exit slot.

20. A nozzle as described in claim 15, wherein the flow rate adjusting mechanism includes:

an elongated control slot which communicates with a passage leading to the nozzle slot; and a closure member which is movable in the direction of elongation of the control slot to increase or decrease the area of the control slot as the arc of coverage is adjusted.

21. A nozzle as described in claim 20, wherein the interchangeable member is a deflector that determines the vertical angle at which water exits the sprinkler, thereby determining the range of the nozzle, and which is movable relative to the arcuate opening to determine the arc of coverage.

22. A nozzle as described in claim 21, wherein the closure member is connected to the deflector and is normally movable therewith to adjust the area of the control slot as the arc of coverage is adjusted.

23. A nozzle as described in claim 22, wherein the maximum flow rate is preset upon installation of the interchangeable member to provide a desired flow rate per unit area of coverage for the maximum settable arc of coverage.

24. A nozzle as described in claim 23, wherein the closure member is movable relative to the interchangeable member to change the flow rate per unit area of coverage for the maximum settable arc of coverage.

25. A nozzle as described in claim 20, wherein the flow rate adjusting mechanism includes a resilient diaphragm with the control slot extending axially therein.

26. A nozzle as described in claim 25, wherein:

the diaphragm includes a circumferentially extending folded area, the folded area being deformable in response to changes in water pressure to change the size of the control slot; and the thickness and resiliency of the folded area are selected so that changes in the size thereof compensate for pressure variations and thus help keep the flow more constant at elevated inlet pressures.

27. A sprinkler system comprising a plurality of nozzles as described in claim 15, the nozzles including interchangeable members respectively configured to provide at least two different spray ranges.

28. A sprinkler system as described in claim 27 wherein the respective flow rate adjusting mechanisms in the nozzles have different configurations according to the spray ranges of the individual nozzles.

* * * * *